US009392354B2

(12) United States Patent
Willberg

(10) Patent No.: US 9,392,354 B2
(45) Date of Patent: Jul. 12, 2016

(54) HEADPHONES WITH OPTIMIZED RADIATION OF SOUND

(75) Inventor: Michael Willberg, Tutzing (DE)

(73) Assignee: ULTRASONE AG, Tutzing (DE)

( * ) Notice: Subject to any disclaimer, the term of this patent is extended or adjusted under 35 U.S.C. 154(b) by 0 days.

(21) Appl. No.: 14/007,811

(22) PCT Filed: Mar. 29, 2012

(86) PCT No.: PCT/EP2012/055737
§ 371 (c)(1),
(2), (4) Date: Sep. 26, 2013

(87) PCT Pub. No.: WO2012/131006
PCT Pub. Date: Oct. 4, 2012

(65) Prior Publication Data

US 2014/0016812 A1 Jan. 16, 2014

(30) Foreign Application Priority Data

Mar. 29, 2011 (DE) ..... 20 2011 004 575 U

(51) Int. Cl.
*H04R 25/00* (2006.01)
*H04R 1/10* (2006.01)
(Continued)

(52) U.S. Cl.
CPC ..... *H04R 1/1091* (2013.01); *H04R 1/1075* (2013.01); *H04R 5/033* (2013.01); *H04R 1/26* (2013.01); *H04R 2201/10* (2013.01); *H04R 2205/022* (2013.01)

(58) Field of Classification Search
CPC .... H04R 1/1075; H04R 1/1008; H04R 5/033; H04R 1/02; H04R 1/10; H04R 1/26; H04R 1/28; H04R 2201/10; H04R 2205/022; H04R 1/30; H04F 2205/022
USPC ..... 381/371, 341, 300, 301, 309, 74, 370, 381/374, 382; 348/52; 345/8; 379/430; 181/128, 129
See application file for complete search history.

(56) References Cited

U.S. PATENT DOCUMENTS 3,592,978 A 7/1971 Hess
4,037,064 A * 7/1977 Yasuda ..... 381/26
(Continued)

FOREIGN PATENT DOCUMENTS

DE 10000666 7/2001
WO 91/01616 2/1991

OTHER PUBLICATIONS

International Preliminary Report on Patentability issued Oct. 2, 2013 for corresponding international patent application No. PCT/EP2012/055737 (in German with English translation attached thereto).
(Continued)

*Primary Examiner* — Huyen D Le
(74) *Attorney, Agent, or Firm* — Stradley Ronon Stevens & Young, LLP

(57) ABSTRACT

The invention is concerned with headphones having left and right supporting members (9, 19) for a sound transducer (11, 14, 20). In order to allow for an ameliorated out-of-head localization of acoustic or sound events without noteworthy loss of treble and midrange information in a hearing protecting manner the sound transducer (11, 14, 20) occupies a position tilted about a horizontal axis in the viewing direction of a headphones user and on a vertical axis intersecting the horizontal axis.

6 Claims, 4 Drawing Sheets

(51) Int. Cl.
*H04R 5/033* (2006.01)
*H04R 1/26* (2006.01)

(56) References Cited

U.S. PATENT DOCUMENTS

| | | | | |
|---|---|---|---|---|
| 4,972,492 | A * | 11/1990 | Tanaka et al. | 381/380 |
| 6,038,330 | A * | 3/2000 | Meucci, Jr. | 381/371 |
| 6,817,440 | B1 * | 11/2004 | Kim | 181/128 |
| 2003/0103637 | A1 * | 6/2003 | Huang | 381/309 |
| 2005/0238189 | A1 * | 10/2005 | Tsai | 381/309 |
| 2006/0204016 | A1 * | 9/2006 | Pham et al. | 381/74 |
| 2010/0266150 | A1 * | 10/2010 | Wax | 381/309 |
| 2011/0158440 | A1 * | 6/2011 | Mei et al. | 381/309 |
| 2012/0134524 | A1 * | 5/2012 | Peng | 381/380 |
| 2013/0293448 | A1 * | 11/2013 | Jannard | 345/8 |

OTHER PUBLICATIONS

International Search Report mailed Jun. 18, 2012 by the European Patent Office in its capacity as International Searching Authority for corresponding international patent application No. PCT/EP2012/055737 (in German with English translation attached thereto).

* cited by examiner

HEADPHONES WITH OPTIMIZED RADIATION OF SOUND

CROSS REFERENCE TO RELATED APPLICATIONS

This application is the U.S. national phase of and claims priority to International Application Number PCT/EP2012/055737 filed on Mar. 29, 2012 which claims priority to German Patent Application Number 202011004575.7 filed Mar. 29, 2011, the contents of each of which are herein incorporated by reference in their entireties.

BACKGROUND

The invention relates to headphones comprising left and right support members for a sound transducer.

Headphones are known in supra-aural or circum-aural design wherein the sound transducer is positioned in a baffle defining the supporting element of the sound transducer, said baffle being located inside left and right, semi-open or closed ear cups that are attached to the ends of a headphone strap and intended to abut the skull of a headphone user via headphone cushions either on his ear (supra-aural), or in an ear enveloping manner (circum-aural). Typically, each baffle carries a single sound transducer at its center, so that sound radiated by it is emitted in the direction substantially normal to the baffle. A disadvantage of this classical central arrangement of the sound transducer is that it promotes the in-head localization of acoustic or sound events produced by the headphones. Surprisingly effective as measure against the in-head localization has been found to not dispose the sound transducer in the center of the baffle but to dispose it offset out of said center downwardly and predominantly forward in viewing direction of a user. Headphones of this kind are disclosed, for example, in the WO/1991/001616. Even with these headphones sound is emitted in the direction substantially normal to the baffle but not directly into the ear canal. Rather, sound strikes the contoured outer ear of the user of the headphones and is reflected from there into the ear canal, recreating a major percentage of the information needed for the out-of-head localization of the "normal" listening situation in the surrounding space without headphones by means of sound generated through headphones for the user thereof. Depending on the individual shape of the outer ear and the auditory experience of a headphones user the irritating in-head localization in headphones use is overcome in this way. A similar effect is attained with headphones, the shells of which mounted on a headband and hence the baffles of the headphones are forwardly offset and tilted around a vertical axis angled towards the ear canal mounted on the headband (AKG 1000).

A disadvantage of these known headphones with reduced in-head localization is to be seen in the loss of treble and midrange information due to the fact that the sound is predominantly injected into the ear canal only after reflection on the skull of the headphones user and on his external ear structure, which loss of information turns out to more or less individually depend on the shape of the head and ears of the headphones user in practice resulting in selecting the sound level much too high thereby excessively burdening the ear.

SUMMARY OF THE INVENTION

An object of the present invention is to provide headphones of the kind defined above which ensure an improved out-of-head localization of acoustic or sound events without significant loss of treble and midrange sound information.

This object is achieved by claim 1. Advantageous developments of the invention are specified in the dependent claims.

By means of the disposition of the two sound transducers tilted about two axes according to the invention, resulting in a location of the acoustic or sound center more distant from the ear, sound produced through the sound transducer of the headphones aims to the ear of a headphones user in a directed manner essentially avoiding loss of treble and midrange sound information. Due to the relatively large distance of the sound center from the ear of the headphones user, he does receive a listening experience close to a listening experience of a sound source disposed in the surrounding space in contrast to a listening experience received from a headphones sound transducer disposed in the vicinity of the ear. This benefits the out-of-head localization for listening trough headphones.

By means of the displacement of the sound transducer in the horizontal and/or vertical direction in addition to the tilting displacement in accordance with an advantageous development of the invention, especially the in-head localization of acoustic or sound events emitted by headphones can be converted selectively to an out-of-head localization.

An optimization of the suppression of in-head localization of acoustic or sound events in favor of off-the-head localization with acoustic or sound events predominantly perceived from the front through the inventive sound-guide is achieved by offsetting the sound center of the sound transducer with respect to the entrance to the ear canal predominantly forward in addition to the tilting of the transducer about two axes.

A particularly favorable guidance of sound with minimized distortion of sound is achieved by means of the hollow sound-guide body at one end thereof remote from the ear of a headphones user the sound transducer is located and the other end thereof extends to the vicinity of the ear of the headphones user. The sound-guide body may have different shapes. Particularly preferred is a funnel-shaped, and alternatively, a tubular sound guide body. In case of the funnel-shaped sound-guide body the sound transducer is located at the pointed end of the funnel, which funnel provides on its opposite far open end a large sound outlet, which allows, in addition to sounding the entrance to the ear canal to sound a large part of the outer ear. The tubular sound-guide body in contrast thereto enables to target the sound to a smaller ear region and also to use of a plurality of sound guide members connected to the support member to sound the ear by a plurality of tilted and staggered transducers.

Advantageously, each supporting element including the sound-guide body and the sound-guide bodies, respectively are made as a unitary injection molded part of plastic.

BRIEF DESCRIPTION OF THE DRAWINGS

The invention is further illustrated by the drawing.

DETAILED DESCRIPTION OF THE INVENTION

Figure 1:
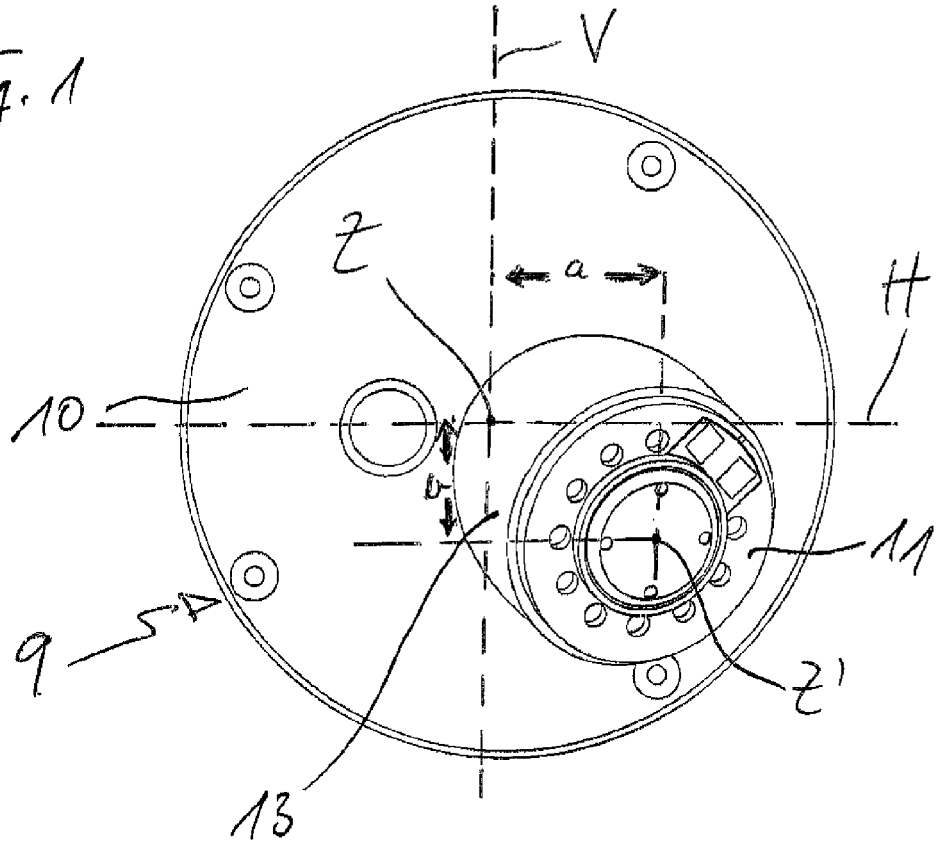
FIG. 1 is a plan view of the side pointing away from the ear of a headphones user of a first embodiment of an element supporting a single sound transducer of the headphones of the present invention comprising a tubular waveguide body receiving the sound transducer.
Figure 2:
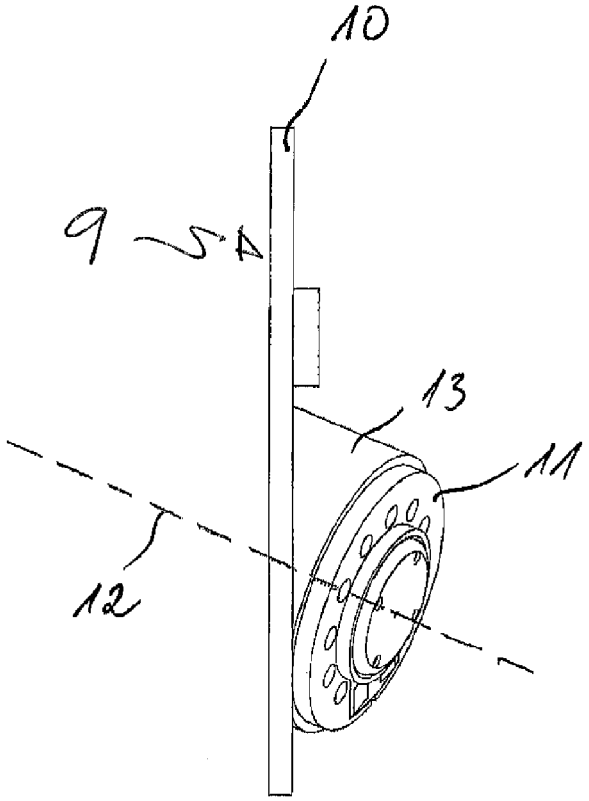
FIG. 2 is a side view of the support element/transducer assembly of FIG. 1.

The support element 9 shown in FIGS. 1 and 2 for a sound transducer 11, from which in FIGS. 1 and 2 only the backside with an electromagnetic driver is visible, is forming part of the right ear cup of stereo headphones. The left ear cup is a mirror image of the arrangement shown in FIG. 1. The support member 9 comprises a flat plate 10 at the circular edge of which a not shown ear pad is arranged, and a hollow sound-guide body 13 in the form of a tube of circular cross section, the longitudinal axis 12 of which runs tilted or angularly with respect to the disk 10. The tubular sound-guide body 13 opens with one end into an eccentric ellipse-shaped opening in the disk 10 and supports at the other end the sound transducer 11 of generally circular disk shape, the longitudinal central axis of said transducer being aligned with the longitudinal axis 12 of the sound-guide body 13.

The center Z of the disk supporting member 9 is located at the height of the entrance to the ear canal of the right ear of the headphones user at the position of the sound transducer in conventional headphones. Starting from this central position, the center Z' of the transducer 11 is shifted or off-set by the distance a along the horizontal axis H in FIG. 1 through the center Z to the right in the viewing direction of the headphones user, and downwardly by the distance b on the vertical axis V through the center Z. Furthermore, the sound transducer 11 is tilted with respect to the supporting member-plate 9 about a vertical axis parallel to the vertical axis V and a horizontal axis parallel to the horizontal axis H, resulting in a corresponding tilting of the tubular sound-guide body 13, meaning that the sound transducer (11, 14, 20) taking a position tilted about a horizontal axis in the viewing direction of a headphones user and a vertical axis intersecting the horizontal axis and that sound generated from the sound transducer is specifically directed to or aimed at the right ear of the headphones user, that is in case of FIGS. 1 and 2 to the entrance to the ear canal. Alternatively the tilt and displacement of the sound transducer with respect to the center Z of the disk support member 9 may be chosen so that a larger part of the outer ear is selectively sounded (provided with sound).

To keep the dimension of the supporting element 9 in direction of an axis perpendicular to the support member disk 10 due to the longitudinal extension of the tubular sound-guide body 13 at a predetermined tilt and offset position of the transducer 11 minimal, the lower edge of the sound transducer 11 supporting the tube end is disposed nearest possible to the support element disk 10, as shown in FIG. 2.

The arrangement of the transducer 11 to the support member 9 as shown in FIGS. 1 and 2 as well as the mirror-image configuration of this arrangement on the left ear ensures a significant reduction of in-head localization of acoustic or sound events encountered in conventional stereo headphones in favor of an out-of the-head localization or off-head localization, especially in favor of an in-front-of-head localization of acoustic or sound events. Moreover, this kind of sounding or sound provision for the headphones user generates an extremely clean, highly resolved and spatial sound image based on the sound events reproduces by the headphones.

Figure 3:
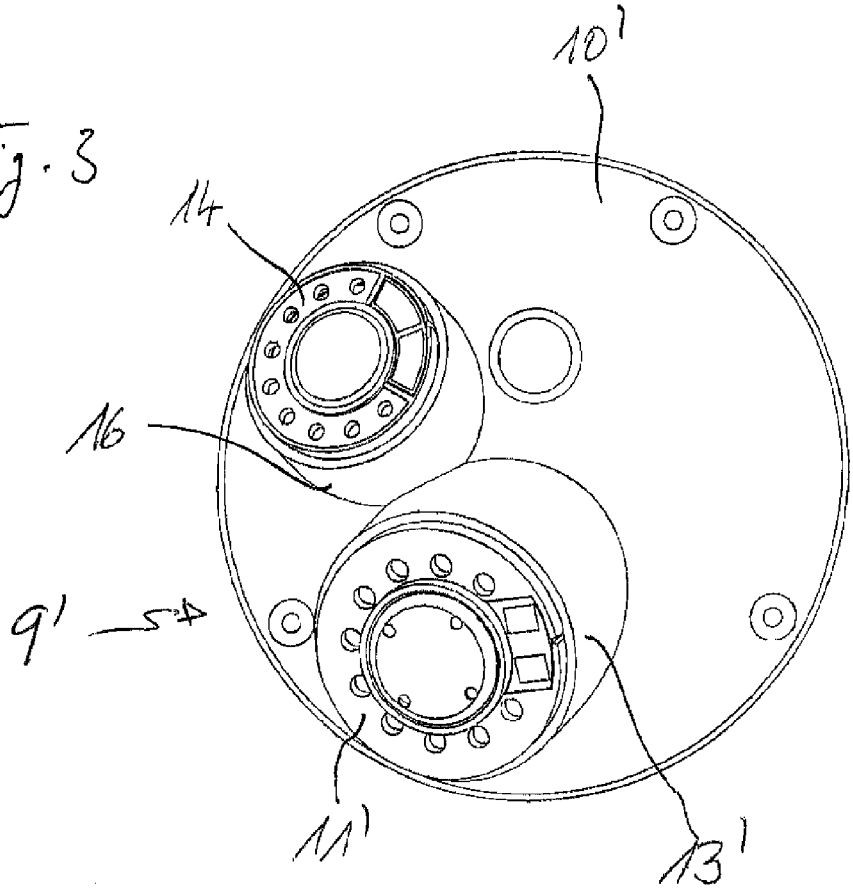
FIG. 3 is a plan view of the side pointing away from the ear of a headphones user of a second embodiment of an element supporting two sound transducer of the headphones of the present invention comprising two tubular waveguide bodies receiving each one of the two sound transducers.
Figure 4:
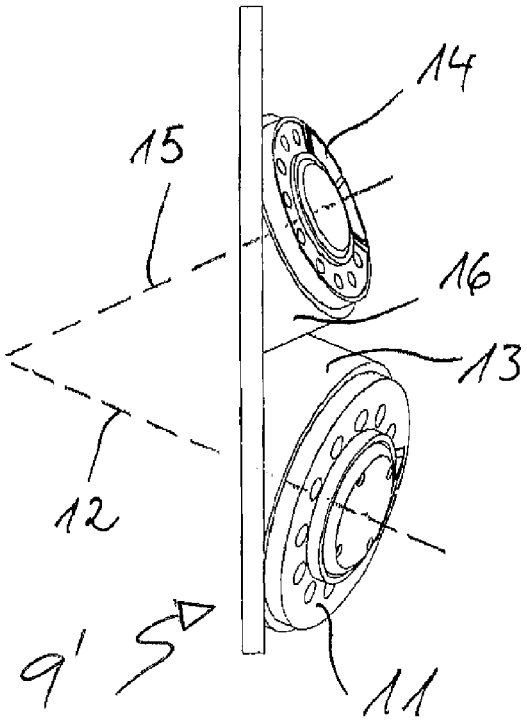
FIG. 4 is a side view of a support element/transducer assembly of FIG. 3.

FIGS. 3 and 4 show a modification of the support member/sound transducer assembly of FIGS. 1 and 2 for the sounding of the left ear of a headphones user, wherein in addition to the transducer 11' in the position of mirror image to the sound transducer 11 in FIGS. 1 and 2 a further sound transducer 14 is arranged eccentrically and tilted on the disk support member 10' of the support member 9'. Starting from the center of the disk support member 10' the additional sound transducer 14 is disposed predominantly upwardly and forwardly offset to the sound transducers 11'. Like the transducer 11' the additional transducer 14 also is disposed tilted on the supporting member disk 10' such that the sound transducer 14 is directed in or points into sound radiation direction centrically passing through central longitudinal axis 15 as well as the longitudinal center axis 12' of the sound transducer 11' in the direction to the entrance to the auditory canal of the headphones user.

In order to allow the additional sound transducer 14 to be arranged tilted as desired and to be connected to the support member disk 10', it sits at the end remote from the support member disk of a tubular sound-guide body 16, the other end of which is connected flush to an eccentric oval opening in the support member disk 10 in the same manner as the sound-guide body 13'.

Figures 5, 6, 7:
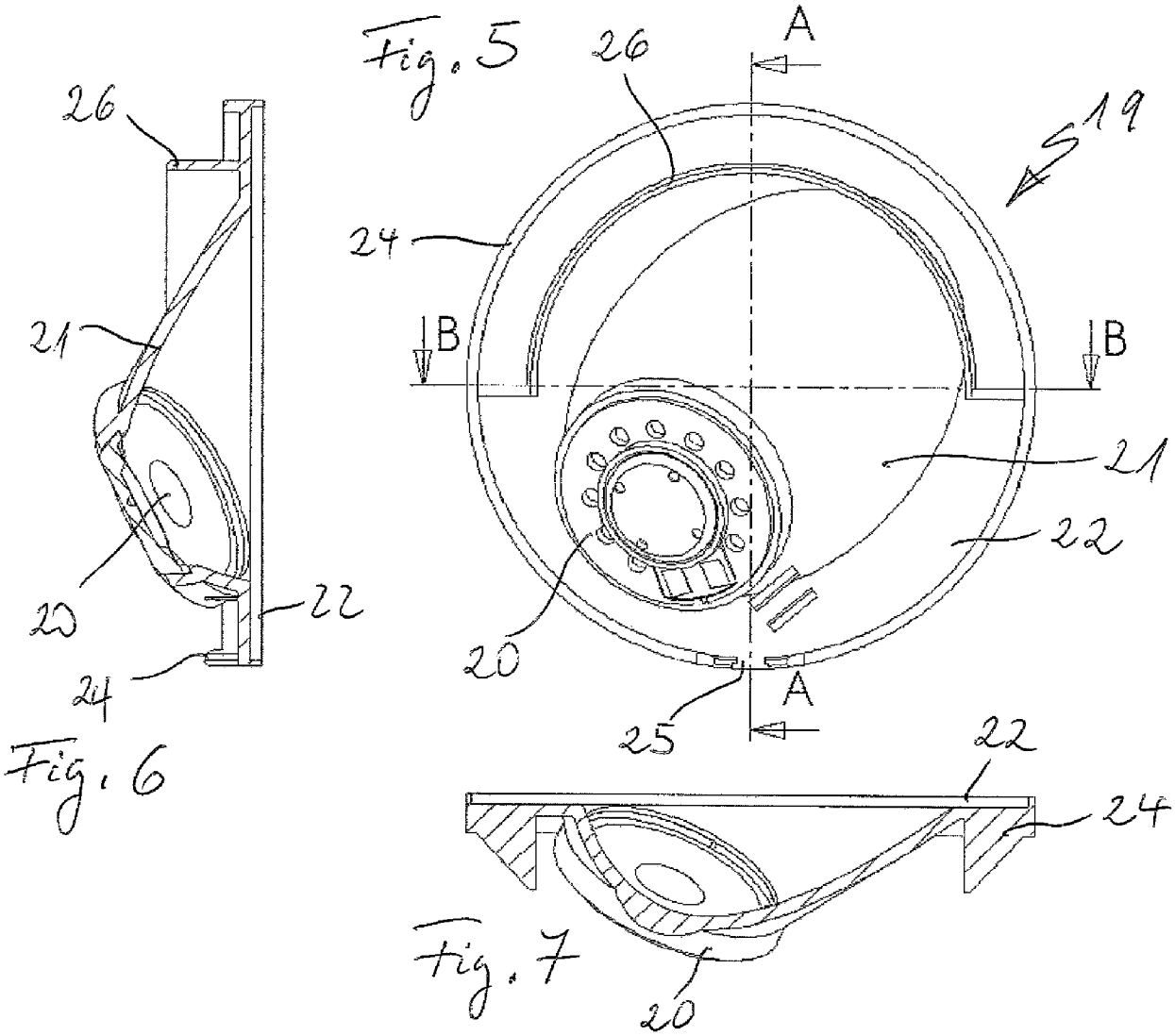
FIG. 5 is a plan view of the side pointing to the ear of a headphones user of a third embodiment of a transducer equipped with a single sound transducer of the headphones of the present invention comprising a funnel-shaped waveguide body receiving the sound transducer
FIG. 6 is a sectional view taken along the line A-A of the support element/transducer assembly of FIG. 5.
FIG. 7 is a sectional view taken along the line A-A of the support element/transducer assembly of FIG. 5.
Figure 8:
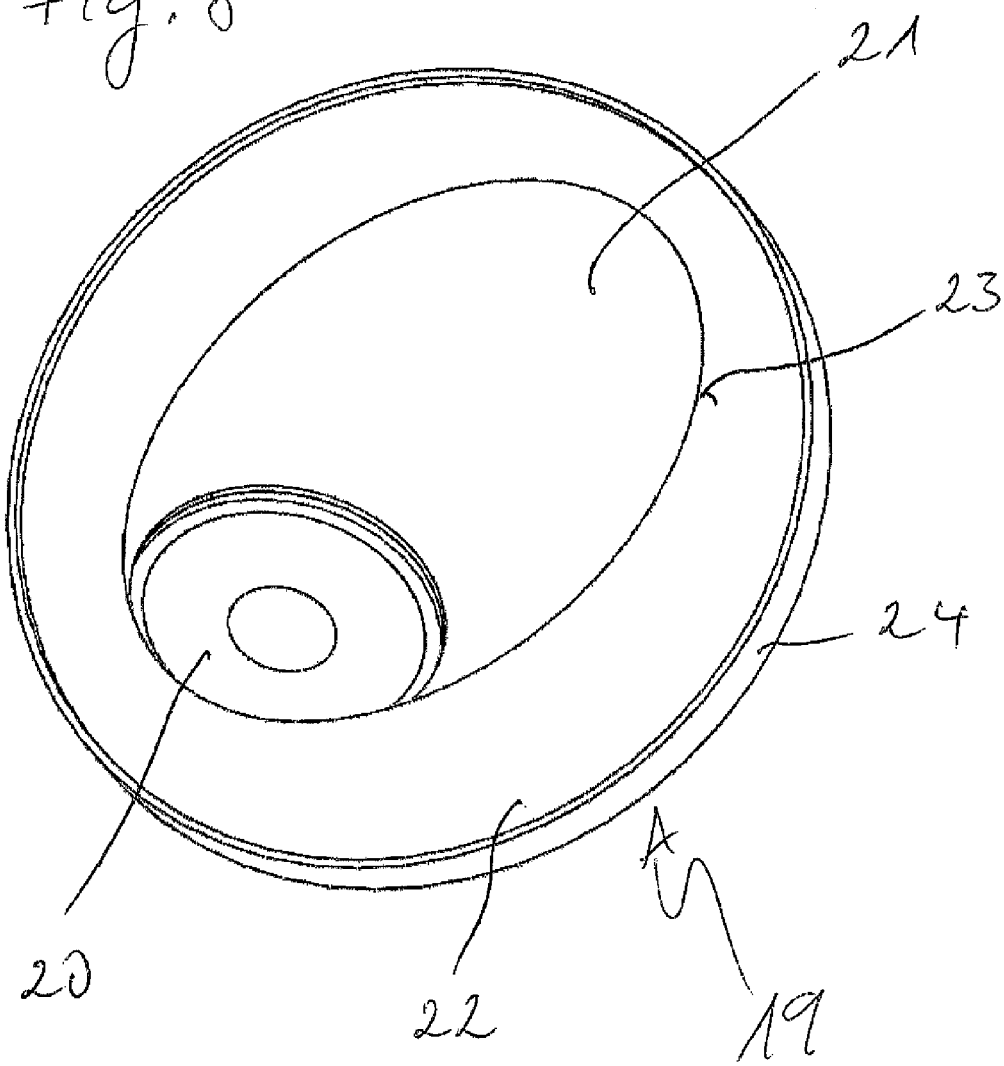
FIG. 8 is a plan view of the sound emitting side of the assembly of FIG. 5.

In the embodiment of the support element/transducer arrangement for irradiation sound to or sound the left ear of a headphones user of the present invention headphones shown in FIGS. 6-7, a single sound transducer 20 is used in a tilt/offset location or disposition mirror imaged to that one shown in FIGS. 1 and 2, said sound transducer being seated at the tip end a funnel-shaped sound-guide body 21 opening with its wide-open end into an oval inner edge 23 of a support member disk 22 of a supporting element 19. The acoustic or sound center of the sound transducer 20 thus again is disposed downwardly and predominantly forwardly offset with respect to the entrance to the ear canal of a headphones user by the support member disk 22 of the stereo.

The support member plate 22 and the funnel-shaped sound-guide 21 constitute a one-piece injection-molded part, preferably an injection molded plastic part, additionally comprising at the outer edge of the support member disk 22 a rearwardly projecting stabilizing collar 24 having a cable guide opening 25 and a circular arc-shaped flange 26 for connection to a not shown headphone bracket.

The invention claimed is:

1. Headphones comprising:

a left support member and a right support member, each of the left support member and the right support member including:

a flat plate having a center and a single opening which covers most of the flat plate, a single funnel-shaped sound-guide body having a wide end having an oval rim and a narrow end opposite the wide end, the wide end attached to the single opening of the flat plate, and a single sound transducer fixed to the narrow end of the sound-guide body, wherein the single funnel-shaped sound guide body is oriented at an angle with respect to the flat plate about a horizontal axis in the viewing direction of the headphones user and about a vertical axis perpendicular to the horizontal axis, and wherein the single sound transducer is offset from the center of the flat plate along both the horizontal and vertical axis.

2. Headphones according to claim 1, wherein each flat plate and single funnel-shaped sound-guide body comprise a one-piece injection-mold made from plastic.

3. Headphones according to claim 1, wherein the horizontal axis and the vertical axis intersect in an acoustic center of the sound transducer.

4. Headphones according to claim 1, wherein the left support member is a mirror image of the right support member.

5. Headphones according to claim 1, wherein further comprising a rearwardly projecting stabilizing collar surrounding the outer edge of each flat plate.

6. Headphones according to claim 5, wherein each stabilizing collar comprises a cable guide opening and a circular arc-shaped flange for connection to a headphone bracket.

* * * * *